United States Patent [19]

Novak et al.

[11] 3,934,692

[45] Jan. 27, 1976

[54] POSITIVE ACTION COIN DISPENSER

[75] Inventors: Frank A. Novak, Seven Hills; Earl O. Schweitzer, Wickliffe; Kamal Naik, Euclid, all of Ohio

[73] Assignee: Ardac, Inc., Willoughby, Ohio

[22] Filed: Feb. 25, 1974

[21] Appl. No.: 445,058

[52] U.S. Cl. ..... 194/4 C; 133/5 R; 221/298

[51] Int. Cl.[2] ..... G07D 1/04

[58] Field of Search ..... 133/2, 4 R, 4 A, 5 R; 221/298; 194/DIG. 9, DIG. 14, 4 C

[56] References Cited

UNITED STATES PATENTS

| | | | |
|---|---|---|---|
| 2,732,923 | 1/1956 | Parker | 133/4 R |
| 3,173,431 | 3/1965 | Chichester | 133/4 R |
| 3,690,332 | 9/1972 | Dykehouse | 133/2 |
| 3,806,710 | 4/1974 | Shigemori | 194/DIG. 9 |
| 3,844,298 | 10/1974 | Schweitzer | 133/5 |

*Primary Examiner*—Robert B. Reeves
*Assistant Examiner*—Charles A. Marmor
*Attorney, Agent, or Firm*—Oldham & Oldham Co.

[57] ABSTRACT

Disclosed is a coin and currency changer utilizing a coin chute having two continuously intersecting arms wherein coins may be alternately stored. A plunger assembly is positioned at the bottom of the chute along the line of intersection of the two arms and is operative to dispense one coin at a time therefrom. The coin in the chute immediately above the dispensed coin is retained within the chute by a pinching action between the plunger assembly and the structure of the chute. A sensor is positioned in operative relation with the plunger assembly and senses the actual dispersal of the coins from the chute. Control circuitry counts the number of coins dispensed and is operative to inhibit functioning of the system if more than the desired number of coins is actually dispensed. There is further provided means for maintaining a proper number of coins within the chute by transferring the coins from a bulk hopper to the chute. Further, the combination of change dispensable by the changer is preprogrammable by a serviceman or alternately could be customer selected or controlled by data computed according to the requirements of any transaction which requires a flexible amount of change.

17 Claims, 3 Drawing Figures

ZERO STATE DETECTOR
76
(ZERO)
(ZERO)
DOWN COUNTER
70
DOWN CLOCK
(I.R.)
POSITIVE EDGE DETECTOR
72
PULSE COUNT
SOLENOID
LATCHING RELAY
MOTOR
INHIBIT RELAY
(BOTTOM)
(ZERO)
MULTIPLEXER
60
(S1)$+(S1)50+(S1)25
(S2)$+(S2)50+(S2)25
(S4)$+(S4)50+(S4)25
(V.S.)$+(V.S.)50+(V.S.)25
(VS) $
(VS) 50
(VS) 25
S1 S2 S4
$
50¢
25¢
BCD INPUTS
15-Sec. ONE SHOT
78
100ms ONE SHOT
80
BOTTOM DETECTOR 38,40
INITIAL RESET (I.R.)
TOP DETECTOR
TIMING CONTROL
TIMING CONTROL

POSITIVE ACTION COIN DISPENSER

BACKGROUND OF THE INVENTION

Heretofore various types of coin and currency changers have been known and utilized. However, most known changers have certain drawbacks with regards to the jamming of coin chutes, the necessity of stacking the coins in a magazine, non-positive payouts, jackpotting, and the inflexibility of the system to adapt to payouts of varying combinations of change for any given currency or coin.

Consequently, it is an object of the instant invention to present a changer utilizing an angled edge stacking coin chute which eliminates the inherent problem of jamming due to coin deformation or the insertion of an improper denomination of coins into a given chute.

Yet another object of the invention is to present a changer which utilizes a bulk hopper wherein coins may be loaded without stacking and from which coins may be uniquely transported for depositing into the angled edge stacking chute.

Still another object of the invention is to present a changer which utilizes a positive payout technique wherein accounting is made of the number of coins actually dispensed rather than the number of times which a coin dispensing mechanism has functioned.

Still another object of the invention is to present a changer utilizing an overpayment detector circuit which immediately terminates the dispensing cycle and inhibits further operation of the changer when a first coin, constituting an overpayment, is dispensed.

A further object is to provide an instantaneously data controlled change system for providing variable change combinations or amounts.

Yet a further object of the invention is to present a changer which is field programmable by a serviceman to preselect the particular combination of coins to be dispensed for any particular change-making operation so as to optimize the utility of the changer.

These objects and other objects which will become apparent as the detailed descripton proceeds are achieved by a positive payout coin and currency changer operative to dispense change from money of any of numerous denominations, comprising: first circuit means for determining the validity of the money for which change is desired and producing a signal indicative of the validity and denomination thereof; coin chutes, one for each denomination of coins to be dispensed, operative to receive coins from associated hoppers and maintain said coins therein, and second circuit means interconnecting said first circuit means and said chutes for receiving and responding to said signal to effectuate the release of respective predetermined numbers of coins from each chute and operative to sense the escapment of each coin from each chute.

For a complete understanding of the structure and techniques of the invention reference should be had to the following detailed description and accompanying drawings wherein.

Figure 1:
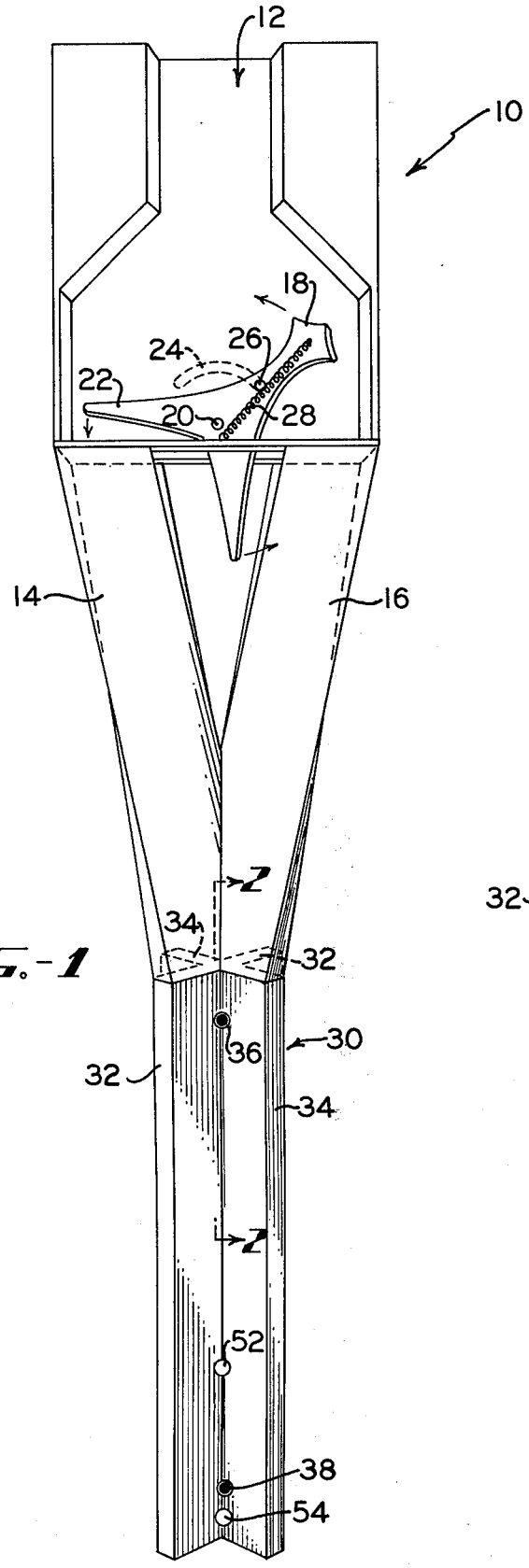
FIG. 1 is a perspective view of the angled-edge stacking chute utilized with the preferred embodiment of the invention.

Referring now to the drawings and more particularly FIG. 1, it can be seen that the money changer of the instant invention preferably utilizes an angled-edge stacking coin chute designated generally by the numeral 10. Such a coin chute is detailedly described in co-pending patent application Ser. No. 336,083, filed Feb. 26, 1973, and now U.S. Pat. No. 3,844,298. The coin chute 10 receives coins from a bulk hopper (not shown) similar in nature to the bulk hopper described in co-pending patent application Ser. No. 413,429 filed Nov. 7, 1973. Suffice it to say, that the bulk hopper utilizes a belt having coin receiving cleats thereon to transport coins from a mass reservoir upward and into the neck 12 of the angled-edge stacking coin chute 10. While reference should be had to the above-identified patent application for a complete understanding of the chute 10, a brief description thereof will here be given so as to facilitate an understanding of the instant invention.

The coins from the bulk hopper are deposited into the neck 12 in a singular time-spaced manner such that the coins fall one at a time upon the flipper 18 positioned therein. The flipper 18 is pivotal about a pin 20 such that the coins falling in the neck 12 and upon the flipper 18 are caused to hit an exposed leg 22 causing the flipper 18 to pivot about the pin 20 and thus directing a coin into an appropriate channel 14, 16. As can be seen, the depositing of the coin into the appropriate channel leaves the flipper 18 in a position so as to direct the next coin into the opposite channel. A slot 24 is presented in the structure of the neck 12 and makes stopping engagement with a pin 26 perpendicularly protruding from the structure of the flipper 18. An anti-bounce spring 28 is interconnected between the top of the flipper 18 and a portion of the structure of the neck 12 at a point below the pivotal pin 20 to prevent bouncing of the flipper 18 after the passing of a coin to guarantee that the flipper will be properly positioned for the passage of the next coin.

The coins, alternately passed into the channels 14, 16, are directed into the coin chute 30 comprising coextensively intersecting arms 32, 34. As can be seen, the channel 14 directs coins into the arm 32 while the channel 16 directs coins into the arm 34. Thus the coins will be stored within the chute 30 alternately between the arms 32 and 34 with each coin supporting a subsequently received coin upon the edge thereof with the two coins having non-aligned edges. As is mentioned in the above referenced patent application, such a coin chute 30 guarantees that no jamming of the chute will occur since no two coins within the chute will have their edges aligned and since the arms 32, 34 of the chute may be of sufficient width to allow for the passage and reception of over-sized or bent coins.

Figure 2:
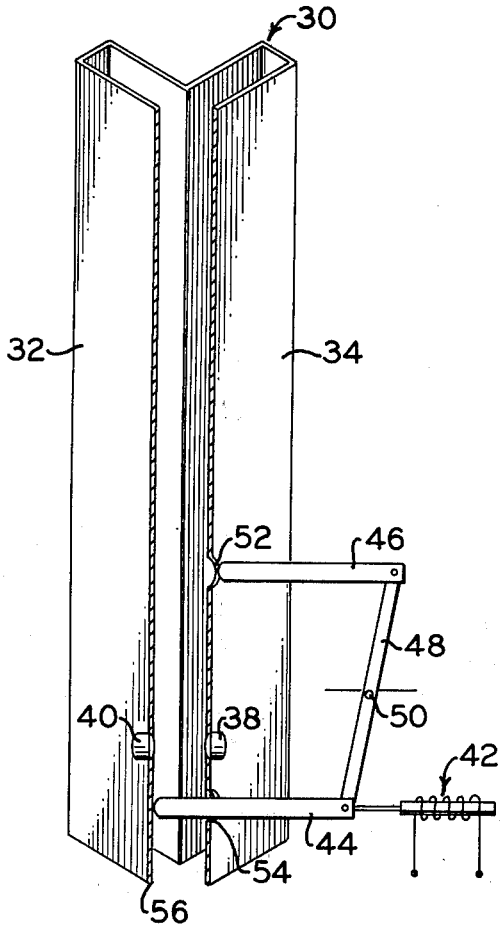
FIG. 2 is a showing of a solenoid-actuated plunger of the invention in cooperation with the chute as shown by taking a section along the line 2—2 of FIG. 1.

As is best seen in FIG. 2, the chute 30 further includes a light source 38 and an associated photodetector 40, the significance of which will become apparent hereinafter. The light sensing means 38, 40 is positioned along the line of intersection between the arms 32, 34 of the chute 30. Also positioned along this line of intersection is a plunger assembly comprising a support plunger or pawl 44 and a pinching plunger or pawl 46. As can be seen, these pawls respectively enter into the confines of the chute 30 at the point of intersection of the arms 32 and 34 through the holes 54 and 52, respectively. The pawls 44 and 46 are interconnected by means of a connecting rod 48 which is pivotal about a pivotal pin 50. A solenoid 42 is operative to control the actuation of the pawls 44 and 46 so that the pawls enter and leave the confines of the chute 30 through the holes 52, 54 in a mutually exclusive manner. As can be seen from the particular embodiment shown, the pawls 44, 46 enter into the chute 30 in such a manner as to come into close proximity with the edge 56 of the arm 32 and thus substantially restrict the common passage of the two arms.

A unique provision of the instant invention is that the connecting rod 48 is substantially one and one half times the diameter of the coin to be associated with the particular chute 30. As can be readily appreciated from an understanding of FIG. 2, with the pawls 44 and 46 positioned as shown in the figure, coins received within the chute 30 will be restrained from dispensing from the chute by the support plunger or pawl 44. Upon appropriate actuation of the solenoid 42, the pawl 44 is withdrawn and a pawl 46 is forced into the chute 30. The coin which was resting immediately upon the pawl 44 is then dispensed from the chute 30 and, simultaneously with the dispensing, the pawl 46 makes contact with the coin immediately opposite the hole 52 and forces the same against the edge 56 thus retaining that coin and all other coins retained in the chute thereabove. As will be further discussed hereinafter, the photodetector 40 will sense the absence of the coin which has been dispensed since light is, subsequent to the dispensing of the coin, passed from the light source 38 to the detector 40. The solenoid 42 is then deactuated and the pawl 44 returns into the chute 30 through the hole 54 while the pawl 46 is removed therefrom. The coin which was pinched against the edge 56 by means of the pawl 46 is then free to drop upon the pawl 44 so as to initialize the chute 30 for another coin dispersal. It should be readily apparent that, with the pawls 44, 46 entering the holes 54, 52 obliquely to the arms 32, 34, there is required but a single solenoid actuated plunger assembly to achieve the dispensing of coins from both of the arms of the chute.

As is also shown in FIG. 1, and as will be elaborated on hereinafter, there is also provided a light source 36 and an accompanying photodetector (not shown) similar to the assembly 38, 40. The assembly utilizing the light source 36 is positioned at a point within the chute 30 such that the presence of a particular number of coins above the support plunger or pawl 44 will block the transmission of light between the source and detector. This detector as will become apparent, guarantees that there is a sufficient number of coins within the chute to achieve a desired dispersal. While the light source 36 may be positioned so as to detect the presence of any particular number of coins, it is preferred that the source 36 and accompanying detector be positioned so as to detect the presence or absence of the maximum payment coin within the chute 30.

As can further be seen from FIG. 2, the light source and detector 38, 40 are positioned at a point closely adjacent the support plunger 44 so as to not be interfered with by means of the coin being pinched against the edge 56 by the plunger 46.

CIRCUIT DESCRIPTION

Figure 3:
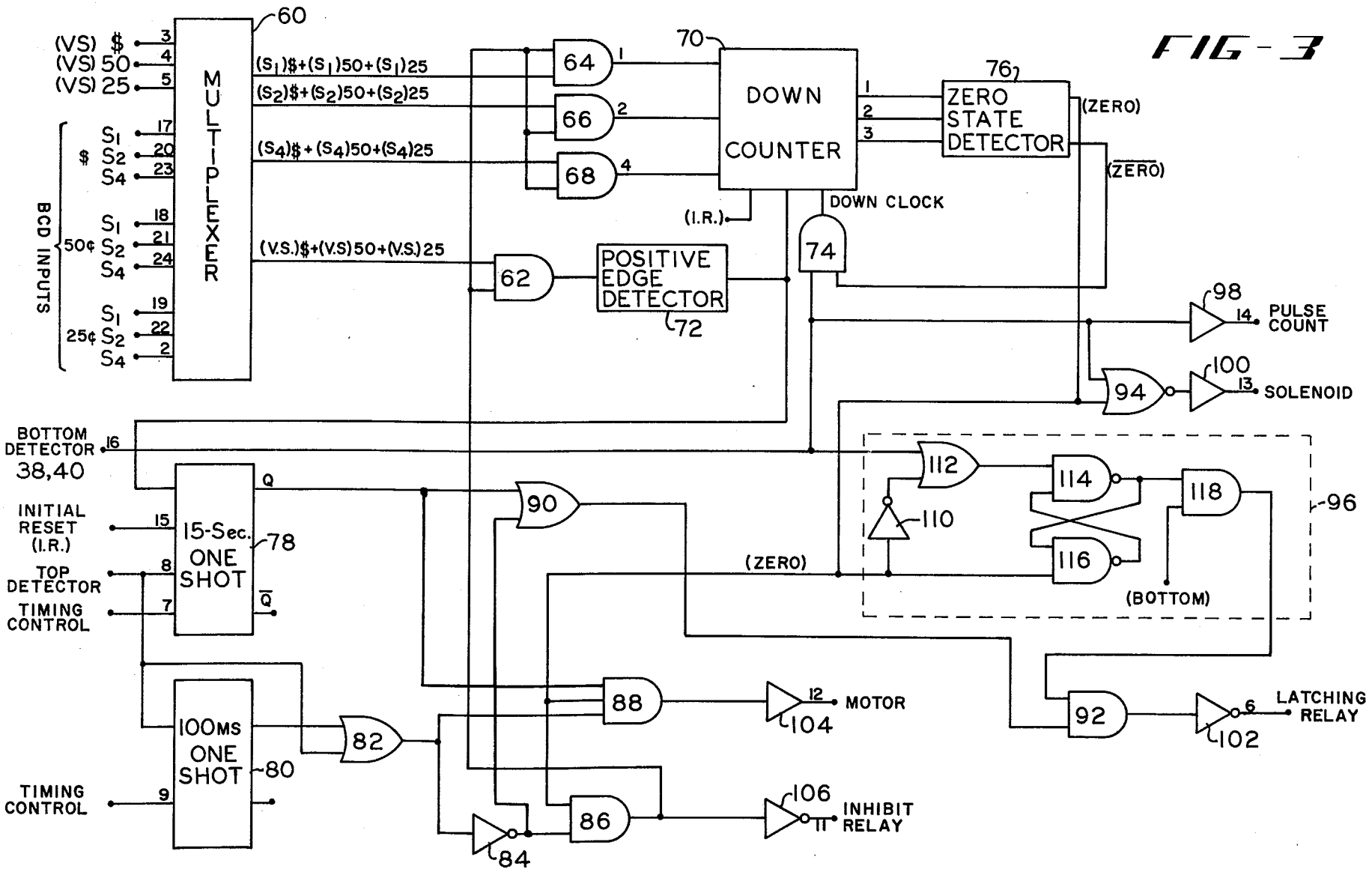
FIG. 3 is a schematic diagram of the control circuitry of the invention.

In FIG. 3 there is presented a preferred embodiment of the control circuitry necessary for achieving the objects of the invention. It is to be understood of course and it will be apparent to those skilled in the art that any of numerous circuit configurations might be implemented to perform the desired functions. It should further be noted that the circuitry of FIG. 3 is but one circuit of a plurality of identical circuits which would be used in a money changer. There would be a circuit similar to that shown utilized for each value of coin which the system would be capable of dispensing in making change. In a dollar bill changer, for instance, there would be three circuits identical to those shown in FIG. 3, one for nickels, one for dimes, and one for quarters. There would similarly be provided three bulk hoppers such as those described hereinabove by reference to the copending patent application. Associated with each of the bulk hoppers would be a coin chute assembly again similar to that described above. For purposes of brevity, only one such circuit will be herein described and it will be understood that one skilled in the art can appropriately interconnect several such circuits, hoppers, and coin chutes to achieve the specific desired structure.

Referring now to FIG. 3, it can be seen that the circuitry of the invention utilizes a multiplexer 60 having three sets of binary coded decimal (BCD) inputs connected thereto. There is one set of such inputs for the appropriate dispensing of change for a dollar, a half dollar, and a quarter. The three sets of BCD inputs are connected to a series of thumb wheel switches or other appropriate programming means (not shown) whereby the particular values S1, S2 and S4 for each of the three sets of inputs might be appropriately chosen. This programming allows the one who maintains the system to preprogram the particular combination of change which will be dispensed by the structure of the invention. Thus the maintenance man may pre-program, for the purposes of the establishment within which the system is placed, that particular combination of change which will be dispensed for each of the various denominations of money which may be changed. Of course, it should be apparent to those skilled in the art that the combinations of change need not be preprogrammed but could indeed be selected by the customer or, in a vending machine application, be dependent on the particular item selected for purchase.

The particular set of BCD inputs which will be evidenced at the output of the multiplexer 60 is determined by the presence of any one of three vend signals (VS) as shown and as is well known in the art. A vend signal is created when the associated currency validity tester of the invention determines that the money for which change has been sought is indeed valid. Such validity detectors are well known in the art and it should be understood that any of numerous such detectors would be appropriate for achieving the objects of the invention. Evidence of the presence of a vend signal is also passed as an output from the multiplexer 60 and applied to an input of the AND gate 62. The BCD outputs of the multiplexer are respectively applied to the AND gates 64, 66 and 68 which in turn feed the down counter 70. The output of the down counter 70 feeds a zero state detector 76 which fundamentally comprises decode circuitry determining when the down counter 70 has reached a count of 000. As will be discussed hereinafter, a count of 000 is achieved by the down counter 70 either on initial reset of the system or after the proper payment of coins with which the circuitry is associated. At that time, the true output of the circuit 76 is at a logic one state and enables the AND gate 86.

The other input of the AND gate 86, as will also be discussed hereinafter, is an indication of the presence of a particular number of coins within the coin chute 30 as indicated by the upper light source and photo detector 36. When the zero state detector 76 is set and when the proper number of coins are positioned within the coin chute 30, the output of the AND gate 86 is at a high level thus enabling AND gates 64 – 68 to present the output of the multiplexer 60 at the input of the down counter 70. The output of the AND gate 86 is also applied to the AND gate 62 which combines with the presence of the vend signal to actuate the positive edge detector 72 which presents a pulse upon the rising edge of the output of the AND gate 62 to preset the down counter 70 at the binary value indicated by the outputs of the AND gates 64 – 68. Quite obviously, if a binary state other than zero is set into the down counter 70, the zero state detector 76 will reset indicating that the down counter 70 is not at a zero value.

With the zero state detector 76 reset, the AND gate 74 is enabled to receive signals from the bottom detector comprising the light source and photo detector 38, 40 described hereinabove. With a coin resting on the support plunger or lower pawl 44, the light between the source 38 and detector 40 is inhibited and a low level is presented to an input of the AND gate 74 and the NOR gate 94. It should be appreciated than that both of the inputs to the NOR gate 94 are at a low level and hence the output of that gate and the subsequent output of the driver 100 are at a high level and the solenoid 42 is actuated so as to dispense the coin resting upon the support plunger 44 and pinch the coin immediately thereabove by means of the pinching plunger 46 in the manner described above. The coin lowermost in the chute therefore passes from the chute and is dispensed as a portion of the change to be made.

With the bottom coin dispensed, light passes from the source 38 to the detector 40 thus presenting a logic 1 level at the input of the enabled AND gate 74 thus clocking the down counter 70 once and causing the same to count down 1 count. Simultaneously, a one level is passed to the NOR gate 94 which, through the driver 100, releases the solenoid 42 thus withdrawing the pinching plunger 46 and forcing the support plunger 44 into the chute to allow the coins therein to again be prepared for a subsequent dispensing. When the coins fall upon the lower pawl 44, the photo detector circuitry 38, 40 again presents a zero level to an input of the NOR gate 94 again causing actuation of the solenoid and a subsequent dispensing of the coin. The absence of the coin is again detected by the circuitry 38, 40 and this condition is signalled to the down counter 70 via the AND gate 74. This process continues until such time as the down counter 70 has been counted down to zero. At that time, the zero state detector 76 sets and the NOR gate 94 is consequently latched with its output at a logic zero thus disabling the actuation of the solenoid 42.

As can be seen, there is also provided a driver 98 directly connected to the output of the bottom detector 38, 40 and producing an output pulse upon the dispersal of each individual coin. It is preferred that the output of the driver 98 be connected to individual counters whereby the total number of coins dispensed by each of the various circuits of the system may be tallied so as to present a running total of all coins dispensed.

It should be here briefly noted that the structural positioning of the light source 38 and photo detector 40 with respect to the support plunger 44 is important to guarantee the proper actuation of the solenoid 42 and to guarantee that but a single coin will be dispensed with each actuation thereof. For this purpose, the bottom detector 38, 40 is positioned directly above the positioning of the lower pawl 44 so as to guarantee that the light passed between the elements 38 and 40 will be blocked until such time as the coin has almost totally escaped from the chute 30. The mechanical delay characteristic of the solenoid and plunger assembly allows the coin to totally escape and to pass the remaining distance of the chute 30 after clearing the light path between the elements 38 and 40 so as to guarantee that the coin has totally cleared the actuation path of the lower pawl 44 before the pawl makes its movement back into the confines of the chute 30.

A unique provision of the instant invention is the incorporation of an overpayment detector 96. As can be seen, one input of the detector 96 is the true output of the zero state detector 76 while the other output thereof is the signal created by the bottom detector 38, 40. Fundamentally, the overpayment detector 96 comprises a sequence detector which detects a change in state of the signal from the bottom detector 38, 40 when the other input to the circuit 96 is at a logic one level indicating that the down counter 70 has counted down. In other words, the overpayment detector 96 is operative to detect the subsequent passing of a coin after the proper number of coins has been dispensed. This is commonly referred to in the art as a jackpotting effect and the circuit 96 is presented to detect the same. The overpayment detector 96 is normally in a reset condition such that the setting of the same produces a logic zero at the output which in turn produces a logic one at the output of the inverter 102 which forces a latching relay (not shown) to actuate. Normally closed contacts of the latching relay conduct the power from the power supplies of the system to the circuitry and operating mechanisms thereof. Consequently, the actuation of the latching relay disconnects the power supply from the circuitry thus inhibiting the entire mechanism of the system and presenting the same in an inoperative form. Thus it can be seen, that the system is rendered inoperative upon the detection of the first coin passing during jackpotting.

It should be apparent to those skilled in the art that any of numerous circuit configurations might be developed to satisfy the desired function of the overpayment detector 96. One particular embodiment is illustrated within the dotted block 96 to comprise the inverter 110, OR gate 112, NAND gates 114, 116 and AND gate 118. As is well known to those skilled in the art, the gates 114 and 116 are interconnected to form a latch or flip flop. It should be readily appreciated that when the changer is prepared to receive money the true output of the zero state detector 76 is at a logic 1 while the output of the bottom detector 38, 40 is a logic zero. Consequently, the latch 114, 116 is set at a logic 1 with the output of the AND gate 118, and consequently the zero state detector 96, being at a logic zero level. When a vend signal is received, as discussed above, the true output of the zero state detector 76 goes to a logic zero latching the output of the flip flop 114, 116 at a logic zero not withstanding the toggling of the output of the bottom detector 38, 40 as coins are dispensed. The output of the AND gate 118 is consequently held at a logic zero level. Directly after the proper payout is completed, the true output of the element 76 goes to a logic 1 as described above. At this instant in time the output of the bottom detector 38, 40 is at a logic 1 since the coin immediately positioned above the last coin dispensed is pinched between the upper pawl 46 and the chute structure. After this coin falls down onto the support plunger 44, the output of the detector 38, 40 goes to a logic zero causing the output of the flip flop 114, 116 to latch at a logic one. Now, if the coin resting upon the support plunger 44 is dispensed or "paid out" then the detector 38, 40 will supply a logic 1 to the associated input of the AND gate 118 thus causing the output of that gate to go to a logic 1 indicating that an overpayment has been made.

It should of course be apparent that the features necessary for achieving the objects of the overpayment detector 96 might also be supplied by means of comparator logic operative to receive BCD data relating to the number of coins to be dispensed and other BCD data relating to the number of coins actually dispensed and producing outputs indicating the correlations between the two.

As can be seen, there is a second input to the AND gate 92 which can similarly cause actuation of the latching relay. This input is from the OR gate 90 which itself has two inputs which will be discussed directly hereinafter.

There is provided with the control circuitry of the invention a 15 second one shot 78 and a 100 millisecond one shot 80. It should be apparent from an understanding of the bulk hopper as identified in the abovementioned copending patent application, that there is provided a motor which, when caused to drive, drives a belt which conveys the coins from the bulk reservoir upward and into the neck and down the chute of the chute assembly 10. The one shot 78 is operative to control the timing for which the motor will run and more particularly to control the maximum amount of time which the motor will be allowed to run. Upon actuation of the one shot 78, the true output will go to a high state for a 15 second duration. Of course, it should be readily understood that the time duration of the one shot 78 is controlled in a normal manner by appropriate adjustment of an RC circuit connected to the timing control line. As can be seen, the one shot 78 may be actuated by any of three signals all of which are operative to begin anew a 15 second timing duration. The first of these signals is the output of the positive edge detector 72 which is indicative of the fact that a vend signal has been established and the zero state detector 76 is set and there are the appropriate number of coins contained within the chute. The one shot 78 is also initialized by means of the initial reset signal (IR) which is created in the normal manner when power is first turned on for the system. A third means for actuating the 15 second time interval is the actuation of the top detector comprising the upper light source 36 and its associated photo detector. Any one of these three signals will initiate a 15 second time interval output from one shot 78.

The one shot 80 is again adjustable by means of its associated timing control arm and is preferably set at a 100 millisecond time interval. This one shot is provided for time delay purposes only and is actuated each time that a signal is produced by the top detector. As can be seen, the signal produced by the top detector is also applied to an input of the OR gate 82. The other input of the OR gate 82 is the 100 millisecond output pulse from the one shot 80. It should be apparent that if no coin is blocking the light transmission of the top detector then the output of the OR gate 82 will be at a high level. In other words, the output of the OR gate 82 indicates the absence of a coin blocking the light transmission associated with the top detector. As coins drop down the chute 30 and intermittently pass through the light path of the top detector, false signals would be emitted indicating the presence of a coin at that level. To alleviate this problem, the one shot 80 provides, upon the immediate sensing of the leading edge of a coin, a 100 millisecond positive level pulse which is applied to the OR gate 82 to negate the effect of the zero level pulse created by the top detector during the passage of the coin.

The output of the OR gate 82 which indicates the absence of a particular number of coins within the chute 30 is applied to an input of the AND gate 88. There is further applied to an input of the AND gate the output of the zero state detector 76. A further input to the AND gate 88 is the true output of the one shot 78 which will be at a logic one level for a 15 second period time duration from the receipt of any one of the abovementioned pulses. Thus it can be seen that the output of the AND gate 88 is at a high level when a particular number of coins is not present within the chute and when the output of the zero state detector 76 indicates that the down counter 70 has counted down and when the output of the one shot 78 is at a high level. The output of the AND gate 88 is applied through the driver 104 to the motor associated with the bulk hopper which achieves the loading of the chute 30. Thus it should be apparent that the motor will not operate to further attempt the delivery of coins from the bulk reservoir to the chute if the desired number of coins is present in the chute or if the output of the down counter 70 is not at a zero level or if the 15 second timer is not actuated. It should be readily apparent then that the intereaction of the three circuit elements by means of their application to the AND gate 88 guarantees that the chute 30 will always maintain a sufficient number of coins to achieve a change making operation.

The output of the OR gate 82 passes through an inverter 84 and is then applied to an input of the OR gate 90. The output of the inverter 84 is indicative of the fact that there are indeed a particular number of coins within the coin chute 30. It should now be readily apparent that by means of the OR gate 90 the latching relay mentioned hereinabove is actuated to disconnect the power supply from the circuitry of the system if the predetermined number of coins is not present in the chute after the motor has been caused to operate for a 15 second time period. In other words, if the prescribed number of coins is not present in the chute and if the output of the one shot 78 is at a low level then a low level input will be incident to the AND gate 92 creating a logic one level at the output of the inverter 102 thus actuating the latching relay. Consequently, the system is operative to disable the entire system when it is discovered that there are either insufficient coins in the bulk hopper to load the chute or there has been a jamming or malfunction whereby the loading of the chute cannot be achieved.

There is further provided in combination with the circuitry of the invention a control loop for an inhibit relay which prevents the insertion of a subsequent piece of money for change while another change operation is being performed. As can be seen, the inhibit relay receives two signals, the output of the zero state detector 76 and the complementary output of the OR gate 82. In other words, the output of the AND gate 86 will be a zero and consequently the output of the inverter 106 will be a one at any time that the zero state detector 76 is at a reset condition or when there are fewer than the prescribed number of coins within the chute 30. It should be readily apparent that these two conditions will exist when a change operation is being performed. As was mentioned hereinabove, any total system will include several of the identical circuits as shown in FIG. 3 and in such incidence the outputs of the inverter 106 may be wire-ORed together and applied to the single inhibit relay such that no money will be received for change while any of the circuits are still in the operation of making change. Similarly, the outputs of the respective inverters 102 may also be wire-ORed together.

Thus it can be seen that the objects of the invention have been achieved by the structure and technique presented hereinabove. While in accordance with the Patent Statutes only the best mode and preferred embodiment of the invention have been presented and described in detail, it is to be understood that the invention is not limited thereto or thereby. Consequently, for an appreciation of the scope and breadth of the invention reference should be had to the following claims.

What is claimed is:

1. A positive payout coin dispenser operative to dispense change for money of any of numerous denominations, comprising:

first circuit means for determining the validity of the money for which change is desired and producing a signal indicative of the validity and denomination thereof;

coin chutes, one for each denomination of coins to be dispensed, operative to receive coins from associated hoppers and maintain said coins therein; and second circuit means, interconnecting said first circuit means and said chutes for receiving and responding to said signal to effectuate the release of respective predetermined numbers of coins from each chute and operative to sense the actual escapment of each coin from each chute; said second circuit means including a solenoid-actuated release mechanism positioned at the bottom of the chute to control the release of coins and a first sensing means positioned above said release mechanism for sensing the passing of a coin from said chute.

2. The coin dispenser as recited in claim 1 wherein said chutes comprise two intersecting arms, each capable of receiving and storing coins, and means for directing the depositing of coins such that each coin will support a subsequently received coin on an edge thereof with the edges being misaligned.

3. The coin dispenser as recited in claim 2 wherein the second circuit means further includes a plunger having two pawls positioned along the intersection of the chute arms and connected to said release mechanism, the pawls being operative to pass into said chute and make contacting engagement with the coins in either of said arms.

4. The coin dispenser as recited in claim 3 wherein one of said pawls makes contacting engagement with the coins by pinching the same between the pawl and the chute and the other makes contacting engagement by supporting coins on their edges, the solenoid actuated release mechanism being operative to cause the pawls to make contacting engagement with the coins in a mutually exclusive manner.

5. The coin dispenser as recited in claim 1 wherein said second circuit means further includes an overpayment detecting means connected to said first sensing means for determining when the number of coins passing from the chute exceeds the predetermined number of coins to be passed.

6. The coin dispenser as recited in claim 5 wherein said overpayment detecting means is operative to inhibit the operation of the changer upon sensing the passage of a first coin in excess of the predetermined number.

7. The coin dispenser as recited in claim 1 wherein said chute comprises two intersecting arms, each capable of receiving and storing coins, and means for directing the depositing of coins such that each coin will support a subsequently received coin on an edge thereof with the edges being misaligned.

8. The coin dispenser as recited in claim 1 which includes a second sensing means positioned adjacent said chute at such a point as to determine the presence or absence of a particular number of coins in said chute and operative to inhibit the operation of the changer if the particular number is not present in the chute at a particular time.

9. The coin dispenser as recited in claim 1 wherein said second circuit means includes programming means providing for the selectability of the combination of change to be dispensed for each of the numerous denominations of money.

10. In a coin dispenser, the improvement comprising:

a chute having two intersecting arms, the arms alternately receiving and storing coins in an angled edge stacked manner;

dispensing means positioned at the bottom of the chute along the intersection of the two arms and operative at said intersection to alternately release coins from each of said arms, said means including a solenoid and an arm connected to said solenoid, the arm having a pawl at each end, said pawls entering the chute at said intersection in a mutually exclusive manner and wherein one of said pawls is operative to support a coin thereon and the other of said pawls is operative to retain a coin by forcing the same against structure of the chute.

11. The improvement in a coin dispenser as recited in claim 10 which further includes sensing means positioned at said intersection between said pawls for sensing the presence and absence of coins between said pawls.

12. In a coin dispenser having validity detection circuitry to ascertain the validity of any of numerous denominations of money and cause the dispensing of coins in change therefore, the improvement, comprising:

first circuit means for selecting a number of coins to be dispensed;

second circuit means connected to the first circuit means for sensing the actual dispersal of coins;

third circuit means connected to the first circuit means for determining when the selected number of coins have been dispensed, said third circuit means including a sequence detector operative to inhibit the changer at that time when the output of the third circuit means indicates that the selected number of coins have been dispensed and the output of the second circuit means indicates that a subsequent coin has been dispensed; and fourth circuit means connected to the second and third circuit means for rendering the changer inoperative for dispensing change upon detection of the first excess dispersal.

13. The improvement in a coin dispenser as recited in claim 12 wherein the second circuit means comprises a photodetector actuated by the dispersal of a coin, and wherein the first circuit means comprises a multiplexer connected to the validity detection circuitry and a counter connected to and controlled by the photodetector.

14. The improvement in a coin dispenser as recited in claim 13 wherein the counter is a down counter connected to and loaded by the multiplexer and the third circuit means comprises a decode circuit operative to sense the output of the down counter and detect a zero level thereat.

15. The improvement in a coin dispenser as recited in claim 12 wherein the first circuit means includes a counter and the third circuit means comprises decode circuitry connected to the counter and the sequence detector and operative to determine when the proper number of coins have been dispensed.

16. The improvement in a coin dispenser as recited in claim 15 wherein the second circuit means comprises a photodetector connected to the counter and the sequence detector.

17. In a coin dispenser having validity detection circuitry to ascertain the validity of any of numerous denominations of money and calls to the dispensing of coins in change therefore, the improvement, comprising:

a multiplexer connected to the validity detection circuitry for selecting a number of coins to be dispensed;

a counter connected to said multiplexer;

a photo detector connected to said counter for sensing the actual dispersal of coins and stepping the counter on each such dispersal;

first circuit means connected to the counter for determining when the selected number of coins have been dispensed; and second circuit means connected to the first circuit means and the photo detector for rendering the changer inoperative for dispensing change on detection of a first excess dispersal.

* * * * *